United States Patent [19]

Sano et al.

[11] 4,444,863

[45] Apr. 24, 1984

[54] PHOTOCONDUCTIVE COMPOSITION AND ELECTROPHOTOGRAPHIC LIGHT-SENSITIVE MATERIAL USING SAID COMPOSITION

[75] Inventors: Kenji Sano; Syunichi Kondo; Hideo Sato, all of Saitama, Japan

[73] Assignee: Fuji Photo Film Co., Ltd., Kanagawa, Japan

[21] Appl. No.: 434,695

[22] Filed: Oct. 15, 1982

[30] Foreign Application Priority Data

Oct. 15, 1981 [JP] Japan ..... 56-165260

[51] Int. Cl.[3] ..... G03G 5/09

[52] U.S. Cl. ..... 430/83; 430/56; 430/81

[58] Field of Search ..... 430/56, 81, 83

[56] References Cited

U.S. PATENT DOCUMENTS 3,236,749 2/1966 Baxendale et al. ..... 430/52
3,615,404 10/1971 Price et al. ..... 430/83 X
3,813,248 5/1974 Futaki et al. ..... 430/81 X

FOREIGN PATENT DOCUMENTS 54-11737 1/1974 Japan ..... 430/83

*Primary Examiner*—Roland E. Martin, Jr.
*Attorney, Agent, or Firm*—Sughrue, Mion, Zinn, Macpeak and Seas

[57] ABSTRACT

A photoconductive composition and an electrophotographic light-sensitive material prepared using the photoconductive composition are described. The photoconductive composition comprises an organic photoconductive material and a urea compound, and may further contain a sensitizing dye capable of increasing the light sensitivity of the organic photoconductive material. The electrophotographic light-sensitive material comprises a support having an electrically conductive surface and a layer of the photoconductive composition, provided on the support. Typical urea compounds as used herein are represented by the general formula (I) or (II):

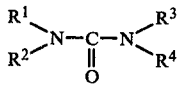

Formula (I)

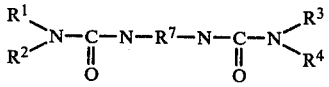

Formula (II)

(wherein all the symbols are described in the specification). The use of the urea compound increases the sensitivity of the organic photoconductive material making it possible to use the organic material in connection with the preparation of electrophotographic light-sensitive materials.

14 Claims, No Drawings

PHOTOCONDUCTIVE COMPOSITION AND ELECTROPHOTOGRAPHIC LIGHT-SENSITIVE MATERIAL USING SAID COMPOSITION

FIELD OF THE INVENTION

The present invention relates to a photoconductive composition composed mainly of an organic photoconductive material, and an electrophotographic light-sensitive material including an electrophotographic light-sensitive layer which is made up of said photoconductive composition. More particularly, it is concerned with a high sensitivity photoconductive composition composed mainly of an organic photoconductive material and a urea compound, and a high sensitivity electrophotographic light-sensitive material having an electrophotographic light-sensitive layer which is made up of said photoconductive composition.

BACKGROUND OF THE INVENTION

Many organic compounds are known to be useful as photoconductive materials for electrophotographic light-sensitive compositions. Furthermore, some organic compounds have very high sensitivity. In practice, however, such organic photoconductive materials are rarely used in the preparation of electrophotographic materials.

Organic photoconductive materials have many advantages over inorganic photoconductive materials. Therefore, it is believed that they will have many uses in the field of electrophotography. Only organic photoconductive materials permit the production of a transparent electrophotographic light-sensitive film, a flexible electrophotographic light-sensitive film, an electrophotographic light-sensitive film which is light in weight and can be easily handled, and so forth. Furthermore, organic photoconductive materials have other excellent characteristics, such as their film-forming properties during the preparation of an electrophotographic light-sensitive material, smooth surface-forming properties, selectivity of charging polarity when used in an electrophotographic process, and forth. Inorganic photoconductive materials do not possess such properties.

However, mainly because of their low light sensitivity and brittleness when in the form of a coating organic photoconductive materials are hardly used in the field of electrophotography even though they have many excellent characteristics.

Investigation have been carried out with respect to heterocyclic compounds having low molecular weight, nitrogen-containing aromatic compounds, and various polymer type aromatic compounds to find organic photoconductive materials having high sensitivity. However, it has now been found that even those compounds which are known to be the most sensitive of organic photoconductive materials are not suitable for practical use without the application of a sensitization processing because their sensitivity is still insufficient. Accordingly, recent studies have been carried out to develop a sensitization method so that higher sensitivity can be obtained. In order to make practical use of organic photoconductive materials, it is essential to choose and apply the most effective sensitization method. The industrial value of an organic photoconductive material is determined to very large extent by the sensitization method being employed because the sensitization method is the biggest factor effecting the sensitivity of an electrophotographic light-sensitive material containing the organic photoconductive material.

The sensitization method which has been most well known in the art is a method involving the addition of a sensitizing dye or Lewis acid. This methed can be applied to almost all organic photoconductive materials. When adding a sensitizing dye, the spectral absorption characteristics of the dye are added to an organic photoconductive material. When adding a Lewis acid, a donor acceptor complex is formed between the Lewis acid and the organic photoconductive material, and this results in the appearance of new spectral sensitivity.

SUMMARY OF THE INVENTION

An object of the invention is to provide a novel sensitizer for an organic photoconductive material.

Another object of the invention is to provide a photoconductive composition which is of high sensitivity and can be used satisfactorily in the preparation of an electrophotographic light-sensitive material.

Still another object of the invention is to provide an electrophotographic light-sensitive film which is transparent, light-weight, easy to handle, and sufficiently satisfactory for practical use.

Other objects and the effects of the invention will become apparent from the following detailed explanation.

The present invention, in one embodiment, relates to a photoconductive composition comprising an organic photoconductive material and a urea compound.

In another embodiment, the present invention relates to an electrophotographic light-sensitive material comprising a support, at least the surface of which is electrically conductive, and a photoconductive composition layer on the support, said layer containing an organic photoconductive material and a urea compound.

DETAILED DESCRIPTION OF THE INVENTION

Organic photoconductive materials as used herein will hereinafter be explained in detail.

Any organic photoconductive materials can be used in connection with the invention as long as they can be sensitized with dyes. Several examples are shown below:

(i) Polymeric organic photoconductive materials

Polymeric organic photoconductive materials which are vinyl polymerization type polymers containing a $\pi$ electron system in the main chain or side chain thereof, and contain a polycyclic aromatic ring or a heteroaromatic ring.

Typical $\pi$ electron systems contained in polymeric organic photoconductive materials include polycyclic aromatic hydrocarbons, e.g., naphthalene, anthrathene, pyrene, perylene, acenaphthene, phenylanthrathene, and diphenylanthrathene; heteroaromatic ring compounds, e.g., carbazole, indole, acridine, 2-phenylindole, and N-phenylcarbazole; and their halogen or lower alkyl-substituted derivatives. Polymers containing such $\pi$ electron systems are used as photoconductive polymers in the invention. Examples of these polymers include vinyl polymers, e.g., polyvinyl naphthalene, polyvinyl anthrathene, polyvinyl pyrene, polyvinyl perylene, polyacenaphthylene, polystyryl anthrathene, ponyvinyl carbazole, polyvinyl indole, and polyvinyl acridine; vinyl copolymers containing the above vinyl compound, such as vinyl naphthalene, vinyl acenaphthylene, vinyl anthracene, vinyl carbazole, etc.; vinyl ether polymers, e.g., polyanthryl methyl vinyl ether, polypyrenyl methyl vinyl ether, polycarbazolyl ethyl vinyl ether, and polyindolyl ethyl vinyl ether; epoxy resins, e.g., polyglycidyl carbazole, polyglycidyl indole, and poly-p-glycidyl antholyl benzene; polymers or copolymers, e.g., polyacrylic acid esters or polymethacrylic acid esters containing the above-described $\pi$ electron system as a substituent, and condensation polymers of the above-described $\pi$ electron base compounds and formaldehyde.

Of the above-described compounds, poly-N-vinyl carbazole and its derivatives containing in the carbazole ring a substituent, such as an aryl group, an alkylaryl group, an amino group, an alkylamino group, a dialkylamino group, an arylamino group, a diarylamino group, a N-alkyl-N-arylamino group, a nitro group, or a halogen atom (these derivatives are hereinafter referred to as "poly-N-vinyl substituted-carbazoles"), and N-vinylcarbazole copolymers are preferred. The poly-N-vinyl substituted-carbazole and copolymers thereof have 1,000 to 10,000, preferably 10,000 to 200,000 of molecular weight.

As N-vinylcarbazole copolymers, those containing at least 50% by mole, preferably at least 70% by mole of an N-ethylenecarbazole constitutional repeating unit represented by the formula as shown below can be used:

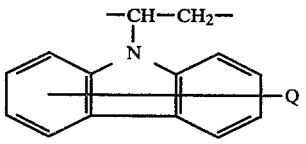

(wherein Q is the same substituent as described for the above-described poly-N-vinyl substituted-carbazoles). Residual constitutional repeating units for the N-vinylcarbazole copolymers include 1-phenylethylene, 1-cyanoethylene, 1-cyano-1-methylethylene, 1-chloroethylene, 1-(alkoxycarbonyl)ethylene, and 1-alkoxycarbonyl-1-methylethylene which are constitutional repeating units resulting from styrene, acrylonitrile, methacrylonitrile, vinyl chloride, alkyl acrylate, and aryl methacrylate, respectively. As the alkyl group of the alkoxycarbonyl group, an alkyl group containing from 1 to 18 carbon atoms can be used. Suitable examples include a methyl group, an ethyl group, a hexyl group, a dodecyl group, an octadecyl group, and a 4-methylcyclohexyl group. The term "constitutional repeating unit" is used herein according to the definition appearing in *Kobunshi (Polymers)*, Vol. 27, pp. 345 to 359 (1978) (Japanese version of *Pure and Applied Chemistry*, Vol. 48, pp. 373 to 385 (1976)).

(ii) Aromatic tertiary amino compounds

Triphenylamine, N,N-dibenzylaniline, diphenylbenzylamine, N,N-di(p-chlorobenzyl)aniline, di($\beta$-naphthyl)benzylamine, tri(p-tolyl)amine, and diphenylcyclohexylamine.

(iii) Aromatic tertiary diamino compounds

N,N,N',N'-Tetrabenzyl-p-phenylenediamine, N,N,N',N'-tetra(p-chlorobenzyl)-p-phenylenediamine, N,N,N',N'-tetramethyl-p-phenylenediamine, N,N,N',N'-tetrabenzyl-m-phenylenediamine, N,N,N',N'-tetramethylbenzidine, N,N,N',N'-tetrabenzylbenzidine, N,N,N',N'-tetraphenyl-p-phenylenediamine, N,N,N',N'-tetraphenyl-m-phenylenediamine, 1,1-bis[4-(dibenzylamino)phenyl]ethane, 1,1-bis[4-(dibenzylamino)phenyl]propane, 1,1-bis[4-(dibenzylamino)phenyl]butane, 1,1-bis[4-(dibenzylamino)phenyl]-2-methylpropane, 2,2-bis-[4-(dibenzylamino)phenyl]propane, 2,2-bis[4-(dibenzylamino)phenyl]butane, 1,1-bis{4-[di(m-methylbenzyl)amino]phenyl}propane, 1,1-bis[p-(dimethylamino)phenyl]-1-phenylmethane, 1,1-bis[p-(diethylamino)phenyl]-1-phenylmethane, bis[4-(dibenzylamino)phenyl]methane, bis{4-[di(p-chlorobenzyl)amino]phenyl}methane, 1,1-bis[p-(dimethylamino)phenyl]-1-phenylethane, 4,4'-benzilidenebis(N,N-dimethyl-m-toluidine), 4',4''-bis(diethylamino)-2,6-dichloro-2',2''-dimethyltriphenylmethane, 1,1-bis[4-(diethylamino)-2-methylphenyl]-1-$\alpha$-naphthylmethane, 4',4''-bis(dimethylamino)-2-chloro-2',2''-dimethyltriphenylmethane, 1,1-bis[p-(diethylamino)phenyl]1-phenylethane, 1,1-diphenyl-5,5-bis[4-(diethylamino)-2-methylphenyl]-1,3-pentadiene, 1,1-diphenyl-3,3-bis-[4-(diethylamino)-2-methylphenyl]-1-propane, bis[4-(dibenzylamino)phenyl]ether, bis[4-(diethylamino)phenyl]ether, bis[4-(dibenzylamino)phenyl]sulfide, 2,2-bis[4-(di-p-tolylamino)phenyl]propane, 1,1-bis[4-(di-p-tolylamino)phenyl]1-phenylethane, and 1,1-bis[4-(dibenzylamino)phenyl]-1,1-diphenylmethane.

(iv) Aromatic tertiary triamino compounds

Tris[4-(diethylamino)phenyl]methane, and 1,1-bis[4-(diethylamino)-2-methylphenyl]-1-[4-(dimethylamino)phenyl]methane.

(v) Condensation products

Condensation products of aldehydes and aromatic amines, condensation products of tertiary aromatic amines and aromatic halides, poly-p-phenylene-1,3,4-oxadiazole, and condensation products of formaldehyde and condensed polycyclic aromatic compounds.

(vi) Metal-containing compounds

2-Mercaptobenzothiazole lead salt, 2-mercaptobenzothiazole zinc salt, 2-mercaptobenzothiazole copper salt, 2-mercaptobenzoxazole lead salt, 2-mercapto-5-phenylbenzoxazole lead salt, 2-mercapto-6-methoxybenzoimidazole lead salt, 8-hydroxyquinoline magnesium salt, 8-hydroxyquinoline aluminum salt, 8-hydroxyquinoline lead salt, 7-benzyl-8-hydroxyquinoline copper salt, and 2-hydroxy-4-methylazobenzene copper salt.

(vii) Heterocyclic compounds (a) Pyrazoline derivatives 1,3,5-Triphenylpyrazoline, 1-phenyl-3-[p-(dimethylamino)styryl]-5-[p-(dimethylamino)phenyl]pyrazoline, 1,5-diphenyl-3-styrylpyrazoline, 1,3-diphenyl-5-styrylpyrazoline, 1,3-diphenyl-5-[p-(dimethylamino)phenyl]pyrazoline, and 1,3-diphenyl-5-(2-furyl)pyrazoline.

(b) 1,2,4-Triazine derivatives

3-[p-(Dimethylamino)phenyl]-5,6-di(p-dimethoxyphenyl)-1,2,4-triazine, 3-[p-(dimethylamino)phenyl]-5,6-di(2-pyridyl)-1,2,4-triazine, 3-[p-(dimethylamino)phenyl]-5,6-di(p-ethoxyphenyl)-1,2,4-triazine, 3-[p-(diethylamino)phenyl]-5,6-di(p-methoxyphenyl)-1,2,4-triazine, and 3-[p-(diethylamino)phenyl]-5,6-di(p-ethoxyphenyl)-1,2,4-triazine.

(c) Quinazoline derivatives 2,4-Diphenylquinazoline, 2-phenyl-4-p-tolylquinazoline, 2-phenyl-4-[4-(dimethylamino)phenyl]quinazoline, 2-phenyl-4-styrylquinazoline, and 2,4-diphenylbenzo[h-]quinazoline.

(d) Benzofuran derivatives

6-Hydroxy-2-phenyl-3-[4-(dimethylamino)phenyl]-benzofuran, 6-hydroxy-2,3-di(4-methoxyphenyl)benzofuran, and 2,3,5,6-tetra(4-methoxyphenyl)benzo[1,2-b: 5,4-b']difuran.

(e) Oxadiazole derivatives 2,5-Bis[4-(dimethylamino)phenyl]-1,3,4-oxadiazole, 2,5-bis[4-(diethylamino)phenyl]-1,3,4-oxadiazole, 2,5-bis[4-(isoamylamino)phenyl]1,3,4-oxadiazole, 2,5-bis[4-(cyclopentylamino)phenyl]-1,3,4-oxadiazole, and 2,5-bis[4-(ethylamino)phenyl]-1,3,4-oxadiazole.

Of the above organic photoconductive materials, materials (i), (ii), (iii), (vii)(a), (vii)(b) and (vii)(d) are preferably used.

As indicated above, photoconductive composition of the invention comprises an organic photoconductive material and a urea compound. In another embodiment of the invention, the photoconductive composition further contains a sensitizing dye capable of increasing the light sensitivity of the organic photoconductive material.

These sensitizing dyes capable of increasing the light sensitivity of the above-described organic photoconductive materials are well known for dye-sensitization of organic photoconductive materials. Typical examples are described in, for example, *Society of Photographic Scientists and Engineers,* 19, 60–64 (1975), *Applied Optics,* Suppl., 3, 50 (1969), U.S. Pat. Nos. 3,037,861, 3,250,615, and 3,712,811 (which are incorporated herein by reference to disclose such sensitizing dyes), British Pat. No. 1,353,264, Research Disclosure, #10938 (109, page 62, published May, 1973), U.S. Pat. Nos. 3,141,700 and 3,938,994, Japanese Patent Application (OPI) Nos. 14560/81, 14561/81, 29586/81, 29587/81, and 65885/81, Japanese Patent Application No. 114259/80, and Japanese Patent Application (OPI) No. 35141/81. The term "OPI" is used herein to mean a "published unexamined Japanese Patent Application". Of these known sensitizing dyes and other dyes capable of increasing the light sensitivity of polymeric organic photoconductive materials, a suitable dye is selected and used.

These sensitizing dyes are used in an amount sufficient to sensitize the organic photoconductive materials used herein. The amount of the sensitizing dye added varies depending on the type of organic photoconductive material and sensitizing dye. In general, it is chosen within the range of from about 0.001 to 100% by weight, preferably from 0.01 to 30% by weight, based on the polymeric organic photoconductive material.

The urea compound used herein is a compound represented by one of the following general formulae (I) and (II):

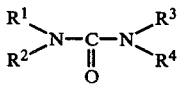

(I)

-continued

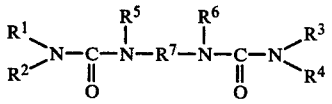

(II)

In general formulae (I) and (II), $R^1$, $R^2$, $R^3$, $R^4$, $R^5$, and $R^6$ may be the same or different, and are each a hydrogen atom; an alkyl group; or a monovalent group derived from a monocyclic or 2 ring-condensation type aryl group or a monovalent group derived from a monocyclic or ring-condensation type heterocyclic ring. $R^1$ and $R^2$, or $R^3$ and $R^4$ may be linked to each other. In the general formula (I), $R^1$, $R^2$, $R^3$, and $R^4$ may be linked together to form a ring. In the general formula (II), $R^7$ is a divalent arylene group, polymethylene group, or alkylene group.

All the urea compounds represented by the general formulae (I) and (II) can be synthesized by the method described in *J. Chem. Soc.,* 1955, 1573–1581. These urea compounds are effective for dye-sensitized inorganic photoconductive materials, e.g., ZnO, as well as for the organic photoconductive materials.

Where any one of $R^1$, $R^2$, $R^3$, $R^4$, $R^5$ and $R^6$ in the general formulae (I) and (II) is an alkyl group, the alkyl group is a straight or branched unsubstituted or substituted alkyl group-containing from 1 to 22 carbon atoms. In this case, it is preferred that one of $R^1$ and $R^2$, and one of $R^3$ and $R^4$ are each a hydrogen atom or a straight or branched alkyl group containing from 1 to 5 carbon atoms. Substituents bonded to the alkyl group include a halogen atom (chlorine, bromine, and fluorine), a cyano group, a nitro group, a phenyl group, and a tolyl group. The number of substituents is from 1 to 3, and the substituents may be the same or different from each other.

When any one of $R^1$, $R^2$, $R^3$, $R^4$, $R^5$, and $R^6$ is a monocyclic or 2 ring condensation type aryl group, the aryl group is a substituted or unsubstituted phenyl group or a substituted or unsubstituted naphthyl group. Examples of such substituents include a halogen atom (chlorine, bromine, and fluorine), a cyano group, a nitro group, a straight or branched alkyl group containing from 1 to 5 carbon atoms, a carboxyl group, a straight or branched alkyl group containing from 1 to 5 carbon atoms, which is substituted by from 1 to 3 groups selected from a cyano group, a nitro group, and a halogen atom (chlorine, bromine, and fluorine) (when the number of substituents is 2 or 3, the substituents may be the same or different), and a straight or branched alkoxy group containing from 1 to 5 carbon atoms. The number of substituents is from 1 to 3, and when it is 2 or 3, the substituents may be the same or different.

When any one of $R^1$, $R^2$, $R^3$, $R^4$, $R^5$, and $R^6$ is a monovalent group derived from a monocyclic or 2 ring condensation type heterocyclic ring, examples of such monovalent groups include a pyrrolidinyl group, a piperidinyl group, a piperidino group, a morpholinyl group, a morpholino group, a pyrrolyl group, an imidazolyl group, a pyridyl group, a pyrimidyl group, an indolinyl group, an isoindolinyl group, an indolyl group, an isoindolyl group, a benzoimidazolyl group, a quinolyl group, and isoquinolyl group, which may be substituted by from 1 to 3 groups selected from a halogen atom (chlorine, bromine, and fluorine), a cyano group, a nitro group, a phenyl group, a tolyl group, a benzyl group, a phenetyl group, and a straight or branched alkyl group containing from 1 to 5 carbon atoms. When the number of substituents is 2 or 3, the substituents may be the same or different.

Examples of groups which are formed when $R^1$ and $R^2$, or $R^3$ and $R^4$ are linked to each other include a divalent group, such as trimethylene group, a tetramethylene group, a pentamethylene group, an oxydiethylene group ($-CH_2-CH_2-O-CH_2-CH_2-$), and their substituted derivatives wherei from 1 to 3 hydrogen atoms of the above divalent group are substituted by a halogen atom (chlorine, bromine, and fluorine), a cyano group, a nitro group, a phenyl group, a tolyl group, a benzyl group, a phenetyl group, and a straight or branched alkyl group containing from 1 to 5 carbon atoms.

In the general formula (II), $R^7$ indicates a divalent arylene group, a polymethylene group, or an alkylene group. Examples of divalent arylene groups include a p-phenylene group, a m-phenylene group, an o-phenylene group, a 1,4-naphthylene group, a 2,3-naphthylene group, and a 4,4'-biphenylene group. Examples of polymethylene groups include polymethylene groups containing from 1 to 22 carbon atoms. Alkylene groups include a propylene group, a butylene group, a pentilidene group, 1,2-dimethylethylene group, a 1,3-dimethyltrimethylene group, a 1,4-dimethyltetramethylene group, a 1,5-dimethylpentamethylene group, a 1,6-dimethylhexamethylene group, 1-ethylethylene group, and a 1,2-diethylethylene group.

Of the urea compounds as used herein, those compounds having at least one aromatic group for $R^1$, $R^2$, $R^3$ or $R^4$, or at least one heterocyclic ring made by a linkage between $R^1$ and $R^2$ or $R^3$ and $R^4$ in the general in the general formula (I) or (II) are preferred in that they provide high light sensitivity. Further, compounds represented by the general formulae (III) to (VIII) are more preferred:

(III)

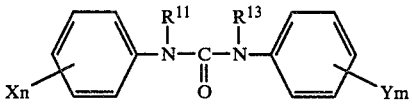

(IV)

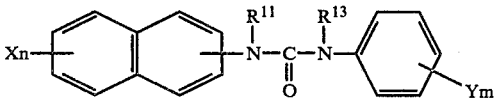

(V)

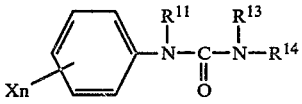

(VI)

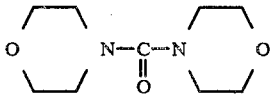

(VII)

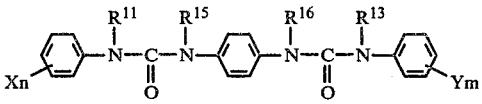

(VIII)

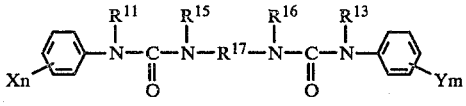

wherein $R^{11}$, $R^{13}$, $R^{15}$, and $R^{16}$ may be the same or different, and are each a hydrogen atom, a straight or branched alkyl group containing from 1 to 5 carbon atoms, or a substituted or unsubstituted phenyl group (wherein the number of substituents is from 1 to 3 and they may be the same or different, including a halogen atom (chlorine, bromine, and fluorine), a straight or branched alkyl group containing from 1 to 5 carbon atoms, a cyano group, a nitro group, a methoxy group, an ethoxy group, a propoxy group, a carboxymethyl group, and a carboxyethyl group);

$R^{14}$ is a substituted or unsubstituted, straight or branched alkyl group containing from 1 to 18 carbon atoms;

$R^{17}$ contains from 1 to 18 carbon atoms, and is a polymethylene group or an alkylene group;

X and Y are each a substituted or unsubstituted, straight or branched alkyl group containing from 1 to 5 carbon atoms (wherein the substituent of the substituted alkyl group is a cyano group, a nitro group, or a halogen atom (chlorine, bromine, and fluorine)), a methoxy group, an ethoxy group, a propoxy group, a halogen atom (chlorine, bromine, and fluorine), a cyano group, a nitro group, a carboxymethyl group, or a carboxyethyl group;

m and n are each 0, 1, 2, or 3, and when m or n is O, X and Y are each a hydrogen atom, and when m or n is 2 or 3, X and Y may be the same or different; and $R^{11}$, $R^{13}$, $R^{14}$, $R^{15}$, $R^{16}$, X, and Y may be the same or different from each other.

Examples of the compounds represented by the general formula (III) are carbanilide

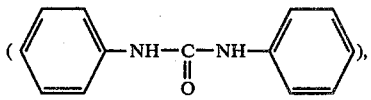

4-chlorocarbanilide, 4,4'-dichlorocarbanilide, 4-chloro-4'-bromocarbanilide, 4,3'-dichlorocarbanilide, 4-bromocarbanilide, 4,4'-dibromocarbanilide, 4,3'-dibromocarbanilide, 4-fluorocarbanilide, 4,4'-difluorocarbanilide, 4-cyanocarbanilide, 4,4'-dicyanocarbanilide, 4-nitrocarbanilide, 4-methyl-4'-chlorocarbanilide, 4-ethyl-4'-cyanocarbanilide, N-methyl-N-phenyl-N'-(4-chlorophenyl)urea, and bis(N-ethyl-N-phenyl)urea.

Examples of the compounds represented by the general formula (IV) are N-(1-naphthyl)-N'-phenylurea, N-(2-naphthyl)-N'-phenylurea, N-(1-naphthyl)-N'-(4-chlorophenyl)urea, N-(2-naphthyl)-N'-(4-chlorophenyl)urea, N-(1-naphthyl)-N'-(4-bromophenyl)urea, N-(1-naphthyl)-N'-(4-toluyl)urea, and N-(1-naphthyl)-N'-(2-methyl-4-chlorophenyl)urea.

Examples of the compounds represented by the general formula (V) are N-phenyl-N'-ethylurea, N-phenyl-N'-(n-butyl)urea, N-phenyl-N'-octylurea, N-(4-chlorophenyl)-N'-ethylurea, N-(4-chlorophenyl)-N'-octylurea, N-(4-bromophenyl)-N'-ethylurea, N-(4-cyanophenyl)-N'-ethylurea, and N-(4-chlorophenyl)-N,N'-diethylurea.

Examples of the compounds represented by the general formula (VII) are N,N'-bis(phenylcarbamoyl)-1,4-phenylenediamine, N,N'-bis-(p-chlorophenylcarbamoyl)-1,4-phenylenediamine, N-(p-chlorophenylcarbamoyl)-N'-(phenylcarbamoyl)-1,4-phenylenediamine, N,N-bis(-bromophenylcarbamoyl)-1,4-phenylenediamine, N-(p-chlorophenylcarbamoyl)-N'-(p-bromophenylcarbamoyl)-1,4-phenylenediamine, N-(p-methylphenylcarbamoyl)-N'-(p-cyanophenylcarbamoyl)-1,4-phenylenediamine, N-(p-ethylphenylcarbamoyl)-N'-(p-nitrophenylcarbamoyl)-1,4-phenylenediamine, and N,N'-diethyl-N,N-bis[N-ethyl-N-(p-chlorophenyl)carbamoyl]-1,4-phenylenediamine.

Examples of the compounds represented by the general formula (VIII) are N,N'-bis(phenylcarbamoyl)ethylenediamine, N,N'-bis(p-chlorophenylcarbamoyl)ethylenediamine, N,N'-bis(p-bromophenylcarbamoyl)ethylenediamine, N,N'-bis(p-chlorophenylcarbamoyl)hexamethylenediamine, and N,N'-bis(p-cyanophenylcarbamoyl)hexamethylenediamine.

In addition to the above-described three components, the photoconductive composition of the invention may contain, if necessary, known additives such as a structure agent, a plasticizer, a dye, and a pigment, within the ranges that the characteristics of the composition are not deteriorated.

Structure agents which can be used include cyanoethyl cellulose, nitrile rubber, polycarbonate of bisphenol A, a linear polyester, a styrene-butadiene copolymer, and a vinylidene chloride-acrylonitrile copolymer. Platicizers which can be used include chlorinated biphenyl, an epoxy resin, a triphenylmethane compound, a cumarone resin, and a low molecular weight xylene resin.

When preparing the photoconductive composition of the invention a uniform solution or a dispersion is formed of the above-described three components and, if necessary, other additives are dispersed or dissolved in a desired proportion to the dispersion or uniform solution. Thereafter, the thus-prepared dispersion or uniform solution is coated on a suitable support and a common solvent is removed by, for example, evaporation. Depending on the purpose, the photoconductive composition solution or dispersion can be used without completely removing the solvent. The electrophotographic light-sensitive layer of the invention is prepared by coating the above-prepared photoconductive composition solution on a suitable support having an electrically conductive surface and drying. In some cases, lamination of, for example, an adhesive layer can be performed.

Common solvents, which are used are capable of dissolving or dispersing the polymeric organic photoconductive material, the sensitizing dye, the urea compounds represented by the general formula (I) or (II) and the other optional components which may be added. Useful solvents may be selected from benzene, toluene, xylene, chlorobenzene, dichloromethane, dichloroethane, trichloroethane, cyclohexanone, tetrahydrofuran, dioxane, and mixtures thereof.

The proportion of the urea compound represented by the general formula (I) or (II) in the photoconductive composition of the invention is determined depending on the amount of the organic photoconductive material which contributes to the photoconductivity and insulative properties of the photoconductive composition. The amount of the urea compound represented by the general formula (I) or (II) being added is from 0.1 to 100 parts by weight, preferably from 1 to 15 parts by weight, per 100 parts by weight of the organic photoconductive material. Addition of the urea compound in amounts not falling within the above-specified range gives rise to problems such as a reduction in the light sensitivity of the resulting photoconductive composition and an increase in residual potential.

As indicated above, the electrophotographic light-sensitive material of the invention comprises a support and a photoconductive composition layer on the support wherein the support is electrically conductive at least at the surface thereof, and the layer is prepared by applying the photoconductive composition of the invention as described hereinbefore.

Supports having an electrically conductive surface which can be used include a drum or sheet made of a metal, e.g., aluminum, copper, iron, or zinc; and paper, plastics, or glass, etc., the surface of which has been made electrically conductive by techniques such as vapor deposition of a metal, e.g., aluminum, copper, zinc, or indium, or an electrically conductive metallic compound, e.g., $In_2O_3$ or $SnO_2$, lamination of a metallic foil, and a method in which carbon black, electrically conductive metallic compound (e.g., $In_2O_3$ or $SnO_2$) powder, or metal powder is dispersed in a binder polymer and coated. Of the supports, the vapor depositioned support of aluminum, indium or $In_2O_3$ and the support having a layer in which metal powder is dispersed in a binder polymer thereon are preferably used.

The photoconductive composition of the invention can be pulverized and dispersed in an insulative solvent, and be used to form an image according to an electrophoretic image-forming photographic method as described in, for example, U.S. Pat. No. 3,384,565 (incorporated herein by reference to disclose such as method) (corresponding to Japanese Patent Publication No. 21781/68), U.S. Pat. No. 3,384,488 (corresponding to Japanese Patent Publication No. 37125/72), and U.S. Pat. No. 3,510,419 (corresponding to Japanese Patent Publication No. 36079/71).

The following examples are given to illustrate the invention in greater detail.

EXAMPLE 1 AND COMPARATIVE EXAMPLE 1

A photoconductive composition solution was prepared by dissolving 10 g of poly-N-vinylcarbazole (PVCz) in 100 ml of 1,2-dichloroethane, and 250 mg of 2,6-di-tert-butyl-4-[4-(N-methyl-N-2-cyanoethylamino)styryl]thiapyrylium tetrafluorobroate (sensitizing dye) was added thereto. The solution was coated on a 100 μm thick polyethylene terephthalate (PET) film with a 60 nm thick $In_2O_3$ vapor deposited layer (electrically conductive layer) provided thereon, and the common solvent was then removed by drying to form a 5 μm thick photoconductive layer (electrophotographic light-sensitive layer). In this way, an electrophotographic film was prepared, which is designated as Electrophotographic Film No. 1.

In addition, a series of photoconductive composition solutions were prepared by adding the urea compounds of the general formulae (III) to (VIII) as shown in Table 1 to part of the above-prepared photoconductive composition solution in the amounts as shown in Table 1 (% by weight, based on the weight of PVCz). In the same manner as described for the preparation of Electrophotographic Film No. 1, each solution was coated on the same PET film as above and dried to form a 5 μm thick photoconductive layer (electrophotographic light-sensitive layer). In this way, Electrophotographic Films Nos. 2 to 12 were prepared.

For Electrophotographic Film Nos. 1 to 12, electrophotographic characteristics were measured with the results shown in Table 1. In evaluating the electrophotographic characteristics, each electrophotographic film was charged in a dark place by the use of a corona charging apparatus so that the surface potential was +500 V and, thereafter, the attenuation of the surface potential in a dark place and under irradiation with light was measured. The electric charge-retention ability is indicated by the percentage of surface potential ($V_{70}$) of the photoconductive layer 70 seconds after charging in a dark place to surface potential ($V_{10}$) of the photoconductive layer 10 seconds after charging in a dark place. Higher values indicate that the electric charge-retention ability of the photoconductive layer in a dark place is higher. The residual potential is a surface potential 20 seconds after irradiation with light, and as its value is smaller, the electrophotographic characteristics are better. The sensitivity $E_{50}$ indicates a light exposure amount which is required to reduce the surface potential to one-half the original value, and the senitivity $E_{90}$ indicates a light exposure amount which is required to decay 90% of the surface potential of the original value. Smaller values indicate that the light sensitivity of the photoconductive layer is higher.

TABLE 1

| Electrophotographic Film | Urea Compound: Structural Formula | Urea Compound: Amount (wt %) | Electric Charge-Retention Ability $V_{70}/V_{10}$ (%) | Light Sensitivity at Wavelength of 630 nm (erg/cm²) $K_{50}$ | $E_{90}$ |
|---|---|---|---|---|---|
| (Comparative Example) | | | | | |
| No. 1 | — | — | 85 | 77 | 441 |
| (Present invention) | | | | | |
| No. 2 | 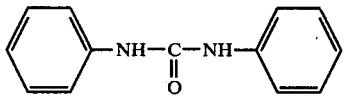 | 5 | 84 | 60 | 360 |
| No. 3 | 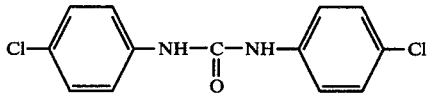 | 5 | 80 | 38 | 198 |
| No. 4 | 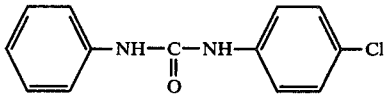 | 5 | 80 | 41 | 199 |
| No. 5 | 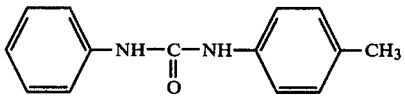 | 5 | 82 | 43 | 238 |
| No. 6 | 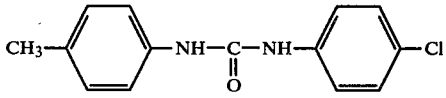 | 5 | 80 | 50 | 292 |
| No. 7 | 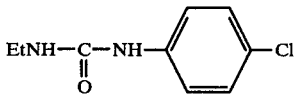 | 5 | 81 | 39 | 236 |
| No. 8 | 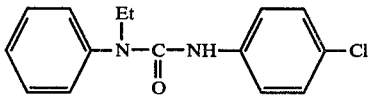 | 10 | 82 | 55 | 338 |
| No. 9 | 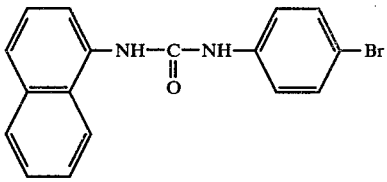 | 5 | 75 | 53 | 306 |
| No. 10 | 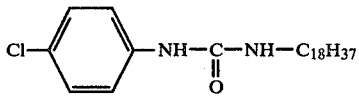 | 5 | 80 | 54 | 326 |

TABLE 1-continued

| Electrophotographic Film | Urea Compound: Structural Formula | Amount (wt %) | Electric Charge-Retention Ability $V_{70}/V_{10}$ (%) | Light Sensitivity at Wavelength of 630 nm (erg/cm²) $K_{50}$ | $E_{90}$ |
|---|---|---|---|---|---|
| No. 11 | 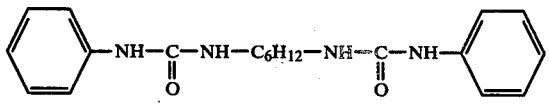 | 2 | 85 | 63 | 380 |
| No. 12 | 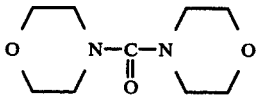 | 5 | 82 | 56 | 337 |

EXAMPLE 2 AND COMPARATIVE EXAMPLE 2

Electrophotographic Film Nos. 13, 15, 17, and 19 were prepared in the same manner as in Example 1 except that the sensitizing dyes shown in Table 2 were each used in place of 2,6-di-tert-butyl-4-[4-(N-methyl-N-2-cyanoethylaminostyryl]thiapyrilium tetrafluoroborate used in Example 1. In addition, by further adding 4,4'-dichlorocarbanilide, Electrophotographic Film Nos. 14, 16, 18, and 20 were prepared.

The electrophotographic characteristics were measured in the same manner as in Example 1, and the results are shown in Table 2.

TABLE 2

| Electrophotographic Film | Sensitizing Dye | Electric Charge-Retention Ability $V_{70}/V_{10}$ (%) | Light Sensitivity at Wavelength of 630 nm (erg/cm²) $E_{50}$ | $E_{90}$ |
|---|---|---|---|---|
| (Comparative Example) No. 13 | 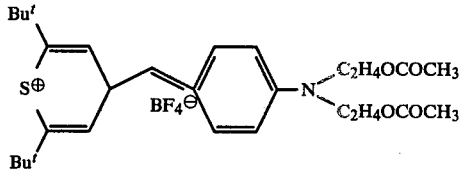 | 88 | 77 | 450 |
| (Present Invention No. 14) | | 84 | 41 | 202 |
| (Comparative Example No. 15 | 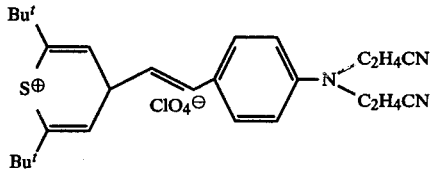 | 83 | 66 | 392 |
| )Present Invention) No. 16 | | 82 | 43 | 238 |
| (Comparative Example) No. 17 | 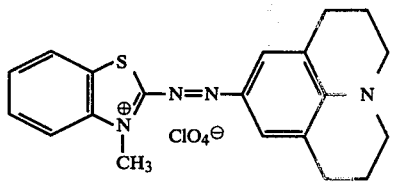 | 82 | 228 | 4200 |
| (Present Invention) No. 18 | | 83 | 128 | 2480 |
| (Comparative Example) No. 19 | 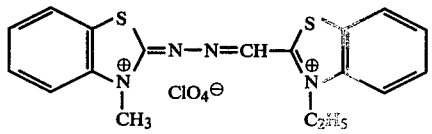 | 90 | 266 | 1460 |
| (Present Invention) No. 20 | | 84 | 180 | 1030 |

Note:
In the above structural formulae, the symbol Bu' indicates a tert-butyl group.

EXAMPLE 3 AND COMPARATIVE EXAMPLE 3

A photoconductive composition solution having the formulation as described hereinafter was prepared and coated on the same PET film as used in Example 1, having an electrically conductive layer. On removing the common solvent by drying, there was formed a 5 μm thick photoconductive layer. In this way, an electrophotographic film was obtained, which is designated as Electrophotographic Film No. 21.

To the above-prepared photoconductive composition solution was added 5% by weight of 4,4'-dichlorocarbanilide based on the 1,1-bis(p-dimethylaminophenyl)-phenylmethane. Using the resulting mixture, an electrophotographic film was prepared in the same manner as above, which is designated as Electrophotographic Film No. 22.

The electrophotographic characteristics of each electrophotographic film were measured in the same manner as in Example 1. The results are shown in Table 3.

| Photoconductive Composition Solution | |
|---|---|
| Polycarbonate (prepared from diphenylcarbonate and 2,2-bis(4-hydroxyphenyl)propane by an ester exchange method) | 10 parts by weight |
| 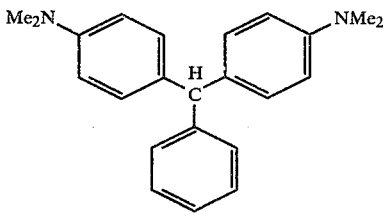 | 8 parts by weight |
| 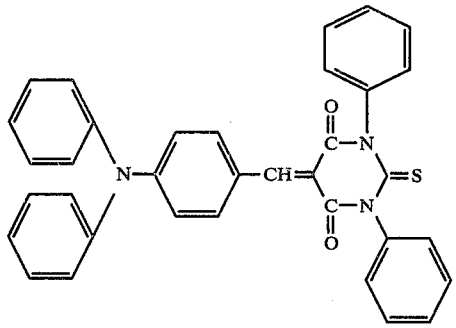 | 0.8 parts by weight |
| Methylene chloride | 70 parts by weight |
| Cyclohexanone | 80 parts by weight |

TABLE 3

| Electrophotographic Film | Electric Charge-Retention Ability $V_{70}/V_{10}$ (%) | Light Sensitivity Tungsten Lamp $E_{50}$ (lux · sec) | $E_{90}$ (lux · sec) |
|---|---|---|---|
| No. 21 (Sample of Comparative Example) | 93 | 50 | 350 |
| No. 22 (Sample of the Invention) | 92 | 38 | 230 |

It can be seen from the above-described results that the electrophotographic films of the invention, having an electrophotographic light-sensitive layer prepared using the photoconductive composition of the invention, Nos. 2 to 12, 14, 16, 18, and 20 are of higher sensitivity than the conventional electrophotographic films Nos. 1, 13, 15, 17, 19, and 21, prepared using the conventional photoconductive compositions.

While the invention has been described in detail and with reference to specific embodiments thereof, it will be apparent to one skilled in the art that various changes and modifications can be made therein without departing from the spirit and scope thereof.

What is claimed is:

1. A photoconductive composition comprising an organic photoconductive material and a sensitizing amount of an urea compound.

2. The photoconductive composition as claimed in claim 1, further containing a sensitizing dye capable of increasing the light sensitivity of the organic photoconductive material.

3. The photoconductive composition as claimed in claim 1 or 2, wherein the urea compound is present in an amount from about 0.1 to about 100 parts by weight per 100 parts by weight of the organic photoconductive material, and is a compound represented by the general formula (I) or (II):

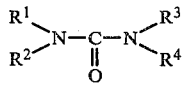

Formula (I)

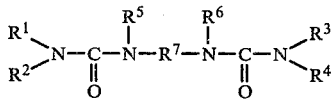

Formula (II)

wherein $R^1$ to $R^6$ may be the same or different, and are each a hydrogen atom; an alkyl group; or a monovalent group derived from a monocyclic or 2 ring condensation type aryl group or a monovalent group derived from a monocyclic or 2 ring condensation type heterocyclic ring;

$R^1$ and $R^2$, or $R^3$ and $R^4$ may be linked to each other, $R^1$, $R^2$, $R^3$ and $R^4$ in the general formula (I) may be combined together to form a ring; and $R^7$ is a divalent arylene group, a polymethylene group, or an alkylene group.

4. An electrophotographic light-sensitive material comprising a support, at least the surface of said support being electrically conductive, and a photoconductive composition layer provided on the support, said composition containing an organic photoconductive material and a sensitizing amount of an urea compound.

5. The electrophotographic light-sensitive material as claimed in claim 4, wherein the photoconductive composition further contains a sensitizing dye capable of increasing the light sensitivity of the organic photoconductive material.

6. The electrophotographic light-sensitive material as claimed in claim 4 or 5, wherein the urea compound is present in an amount from about 0.1 to about 100 parts by weight per 100 parts by weight of the organic photoconductive material, and is a compound represented by the general formula (I) or (II):

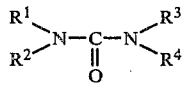

Formula (I)

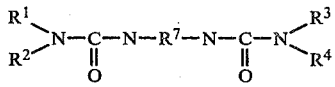

Formula (II)

wherein $R^1$ and $R^6$ may be the same or different, and are each a hydrogen atom; and alkyl group; or a monovalent group derived from a monocyclic or 2 ring condensation type aryl group or a monovalent group derived from a monocyclic or 2 ring condensation type heterocyclic ring;

$R^1$ and $R^2$, or $R^3$ and $R^4$ may be linked to each other, or in the general formula (I), $R^1$, $R^2$, $R^3$ and $R^4$ may be combined together to form a ring; and $R^7$ is a devalent arylene group, a polymethylene group, or an alkylene group.

7. A photoconductive composition as claimed in claim 2, wherein the sensitizing dye is present in an amount of from about 0.001 to about 100% by weight based on the weight of the organic photoconductive material.

8. A photoconductive composition as claimed in claim 7, wherein the sensitizing dye is present in an amount of from about 0.01 to about 30% by weight based on the weight of the organic photoconductive material.

9. A photoconductive composition as claimed in claim 3, wherein the urea compound represented by the general formula (I) or (II) is present in an amount of 0.1 to 100 parts by weight per 100 parts by weight of the organic photoconductive material.

10. A photoconductive composition as claimed in claim 3, wherein the urea compound represented by the general formula (I) or (II) is present in an amount of from 1 to 15 parts by weight per 100 parts by weight of the organic photoconductive material.

11. An electrophotographic light-sensitive material as claimed in claim 4, wherein the sensitizing dye is present in an amount of from about 0.001 to about 100% by weight based on the weight of the organic photoconductive material.

12. The electrophotographic light-sensitive material as claimed in claim 11, wherein the sensitizing dye is present in an amount of from about 0.01 to about 30% by weight based on the weight of the organic photoconductive material.

13. The electrophotographic light-sensitive material as claimed in claim 4, wherein the urea compound represented by the general formula (I) or (II) is present in an amount of from about 0.1 to about 100 parts by weight per 100 parts by weight of the organic photoconductive material.

14. The electrophotographic light-sensitive material as claimed in claim 6, wherein the urea compound is present in an amount of from about 1 to about 15 parts by weight per 100 parts by weight of the organic photoconductive material.

* * * * *